US006098859A

United States Patent [19]

Bortner

[11] Patent Number: 6,098,859

[45] Date of Patent: Aug. 8, 2000

[54] ADJUSTABLE POSITION HARNESS BUCKLE SYSTEM

[76] Inventor: R. Blake Bortner, 16720 Selby Dr., San Leandro, Calif. 94578

[21] Appl. No.: 09/004,541

[22] Filed: Jan. 8, 1998

[51] Int. Cl.[7] ..... A45F 3/04

[52] U.S. Cl. ..... 224/272; 224/195; 224/614; 224/627; 224/637; 224/650; 24/498

[58] Field of Search ..... 224/195, 271, 224/272, 269, 666, 667, 627, 650, 632, 616, 617, 618, 614, 637, 639, 640, 641; 24/498, 585, 68 R

[56] References Cited

U.S. PATENT DOCUMENTS

| | | | |
|---|---|---|---|
| 694,857 | 3/1902 | Henshaw | 24/498 |
| 765,995 | 7/1904 | Rossuck | 24/498 |
| 1,314,392 | 8/1919 | Glamzo | 224/667 |
| 1,355,997 | 10/1920 | Morrison | 24/498 |
| 1,723,147 | 8/1929 | Fourethier | 224/637 |
| 2,580,477 | 1/1952 | Statham | 24/585 |
| 3,136,020 | 6/1964 | Baker | 24/498 |
| 5,722,576 | 3/1998 | Rogers | 224/195 |

*Primary Examiner*—Linda J. Sholl
*Attorney, Agent, or Firm*—Bruce & McCoy

[57] ABSTRACT

An adjustable position harness buckle system which employs a captured track secured to a backpack apparatus along a predetermined path and a clamp mechanism which is engaged with said track and can be clamped thereto by a lever arm actuated cam at any position therealong.

2 Claims, 1 Drawing Sheet

ADJUSTABLE POSITION HARNESS BUCKLE SYSTEM

BACKGROUND OF THE INVENTION

1. Field of the Invention

The present invention relates harness buckles and, more particularly, to an adjustable position harness buckle system for backpack apparatus to permit infinitely adjustable positioning of a buckle along a path lateral to the direction of force which results when the buckle is placed in tension.

2. Description of the Prior Art

The prior art of the present invention utilizes buckles at the ends of straps which can be adjustably positioned with respect to the ends of the straps so that when the interconnecting portions of the buckle are engaged, the straps exert tension on the two parts to which the buckle portions are respectively secured to hold those parts in position with respect to each other.

In the prior art devices, the ends of the straps cannot be moved laterally or perpendicular to the direction of tension in the straps unless the buckle is disconnected and physically moved laterally and reattached to a receptive connection at a position displaced from the prior attachment position. The buckle can only be moved to predetermined alternate positions which provide a receptive connection. There has long been a need in the backpacking and skin diving industries for an adjustable position harness system which permits lateral movement with respect to the direction of tension in a strap. The present invention accomplishes this result, but more importantly it permits infinite adjustment of the positioning of the buckle attachment position along a predetermined path.

SUMMARY OF THE INVENTION

The present invention is an adjustable position harness buckle system for backpack apparatus having straps and accessories which are secured to the backpack or secure various parts of the backpack apparatus together by means of a buckle. In order to perform its function, the buckle sometimes requires the capability of adjustable positioning up and down or along the backpack apparatus essentially in a direction lateral to the direction of force which results when the buckle is placed in tension. The system of the invention is comprised in part of a flexible track having a relatively narrow width and relatively constant thickness along its length. It is securable along one longitudinal edge thereof to a first portion of the backpack apparatus which is engaged to the buckle. The track has an enlarged thickness along the opposite longitudinal edge thereof which is formed for sliding capture in a clamp. A second part of the system is a clamp mechanism which forms a portion of the buckle and has a body portion with a first end thereof secured to a second portion of the backpack apparatus. The second portion of the backpack apparatus is interconnected to the first portion thereof when the clamp mechanism engages the track, and the first and second portions of the backpack apparatus are thereby interconnected in a fixed orientation in a tension positioned relationship with respect to each other. The clamp body portion of the buckle has a reduced entrance opening disposed at the second end thereof which permits the enlarged thickness edge of the track to be captured therein whereby the clamp may be slid and located anywhere along said track. The clamp mechanism includes a cam member secured to one side of the reduced entrance opening in pivoting relationship therewith and has an arm extending therefrom whereby when the arm is rotated toward the first portion of the clamp body, the cam member extends from its respective side of the opening in the clamp body toward the other side thereof. The proximate portion of the relatively constant thickness portion of the track is clamped between the cam member and the other side of the opening thereby engaging the buckle to the track at the proximate portion thereof.

OBJECTS OF THE INVENTION

It is therefore an important object of the present invention to provide an adjustable position harness buckle system which permits adjustable positioning of a buckle in a lateral direction with respect to the direction of force that is created in the straps to which the buckle portions are attached for holding two ends of a buckle system together.

It is another object of the present invention to provide an adjustable position harness buckle system which permits infinite positioning of a buckle along a predetermined path lateral to the direction of tension in a buckle system.

It is a further object of the present invention to provide a new and novel captured track and clamp mechanism attachment system for permitting adjustable engagement of a buckle to the track anywhere along its length.

It is still another object of the present invention to provide an inexpensive, constant engagement, buckle system that permits infinite lateral positioning along a predetermined path of finite length.

And it is yet a further object of the present invention to provide a method for providing an infinitely adjustable position harness buckle system for backpack apparatus having straps and accessories which are secured to the backpack or secure various parts of the backpack together by means of a buckle comprised of a track and clamp mechanism which in order to perform its function, the buckle requires the capability of adjustable positioning up or down or along the backpack apparatus essentially in a direction lateral to the direction of force which results when the buckle is placed in tension.

Other objects and advantages of the present invention will become apparent when the method and apparatus of the present invention are considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

Figure 1:
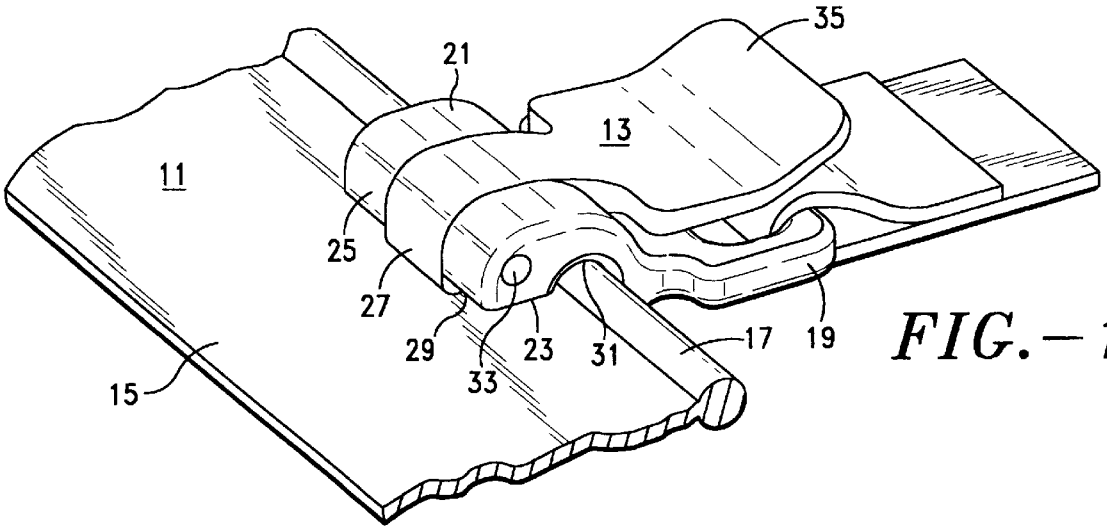
FIG. 1 is a perspective view of the adjustable position harness buckle system for backpack apparatus of the present invention.

FIG. 1 shows a perspective view of an adjustable position harness buckle system. There are two portions to the system which comprise the buckle: a track 11 and a clamp mechanism 13. In the usual buckle, there are two mating elements which are secured to two different portions of a body or separate bodies which are interconnected when the two elements of the buckle are engaged or interlocked. The portions of the buckle are usually secured to the ends of straps with adjustable connections which permit the effective length of the straps to be easily lengthened or shortened.

In the prior art, when the two portions of a buckle are engaged, the straps to which they are attached are placed in tension and any movement of the straps which tends to occur is collinear to the tension in the straps. In many applications, it is desirable to move the positioning of the buckle in a lateral or perpendicular direction to the direction force which results when the buckle is placed in tension. To do this, it is usually necessary to disengage the portions of the buckle and move one of them to an alternative engagement position which must be provided with another receptive engagement portion of the buckle similar to the one from which the moved portion of the buckle was disengaged. This is inconvenient as it releases the interconnection; it is expensive as it requires multiple buckles at various positions; and it is not universal because it allows repositioning only to predetermined alternative positions.

The present invention is comprised of a track 11 and clamping mechanism 13 in place of the typical buckle connection and overcomes all of these problems with a new and novel harness buckle system and method of operation. However, the clamping mechanism portion of the system will be referred to herein at various times as a buckle, even though it is only a part of the buckle system which includes the track.

In the present invention, unlike the usual prior art, the portions of the buckle system are comprised of two dissimilar elements but which still perform the function of engaging to form an interlock. The track portion of the buckle of the preferred embodiment of the present invention is a flexible member made of a rubber-like material having a relatively narrow width and a relatively constant thickness along the length thereof. It is securable along one longitudinal edge 15 thereof to a first portion of the backpack apparatus which needs to be engaged to the buckle. The term backpack apparatus can be either a backpack device or an accessory secured to a backpack device.

The track 11 has an enlarged thickness 17 along the other longitudinal edge thereof for permanent capture in the clamp mechanism 13. The longitudinal edge 15 of the track which is secured to the backpack apparatus is usually oriented in an up and down orientation which, of course, becomes any variety of directions as a user, such as a skin or scuba diver changes his body orientation in the water from upright to horizontal to upside down and all positions in between. The track can also be disposed along any path on the backpack apparatus for the attachment of moveable accessories such as equipment holders or weight pockets.

Figure 2:
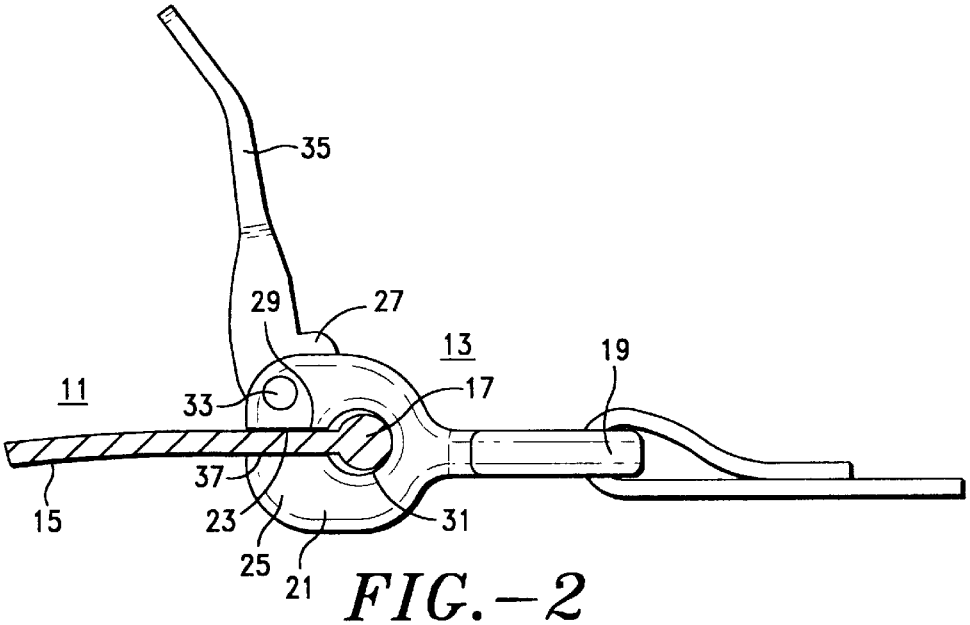
FIG. 2 is a side elevation thereof showing a track in cross-section captured in a buckle with the cam arm raised in unlocked position.
Figure 3:
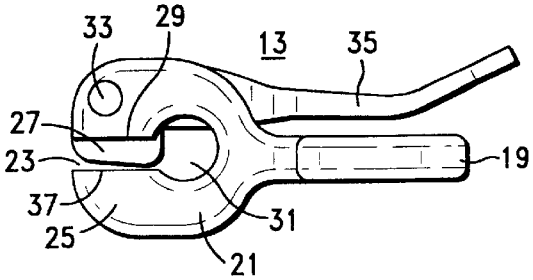
FIG. 3 is am alternate view of FIG. 2 showing a buckle without a track disposed therein and with the cam arm lowered into locked position.

FIGS. 2 and 3 show the clamp mechanism 13 in side elevation with and without the track 11 engaged therewith respectively. The FIGS. show a clamp mechanism or buckle forming a portion of the buckle system which is utilized at the end of a strap to engage another portion of the backpack apart from the track. The buckle or clamp mechanism is affixed to the end of the strap with any one of the usual adjustable length connections (not shown). The buckle has a body portion with a first end thereof 19 which is adjustably secured to a second portion of a backpack apparatus which needs to be secured to the first portion of the backpack apparatus whereby when the clamp mechanism is engaged to a track on the first portion of the backpack, the first and second portions of the backpack apparatus are interconnected in a tension positioned orientation with respect to each other.

The clamp body portion 21 of the buckle has a reduced entrance opening 23 disposed at the second end thereof 25 which permits the enlarged thickness portion 17 of a track 11 to be captured therein whereby the clamp mechanism may be slid along and located anywhere along the track. The clamp mechanism includes a cam member 27 secured to one side 29 of the reduced entrance opening of the track slide hole 31 in pivoting relationship around a pivot pin 33. It has an arm 35 extending therefrom whereby when the arm is rotated toward the first end of the clamp body, the cam member extends from that side of the reduced entrance opening in the clamp body toward the other side 37. As a result, the proximate portion of the relatively constant thickness portion of the track 11 is clamped between the cam member and the other side of the opening, thereby engaging the buckle to the track at the proximate portion thereof.

Thus, the present invention solves many of the problems of the prior art and is a new and novel invention with numerous advantages. Where the prior art is inconvenient because it releases the interconnection between the two portions of the backpack apparatus or between the backpack and an accessory to move the connection laterally to reconnect it to another or displaced buckle connection, the present invention constantly maintains the interconnection because the enlarged edge of the track is always captured in the track slide hole of the clamping mechanism of the buckle. The strap is tightened longitudinally by adjusting the length of the strap that the buckle is secured to.

The prior art adjustable position buckle mechanisms are expensive because they require multiple buckle attachment portions disposed along the path that it may be desirable to move the buckle interconnection. The present invention overcomes that problem by providing an inexpensive flexible track which can be a simple plastic extrusion in place of the multiple individual buckle connections required by the prior art.

And finally, the present invention overcomes the problem of the prior art which permits repositioning of the buckle only to predetermined alternative positions by providing a system which is infinitely adjustable to any position along the desired path of engagement. The buckle of the present invention can be clamped to the track at any position along its length.

Thus it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

I claim:

1. An adjustable position harness buckle system for backpack apparatus having at least one strap end which is secured to said apparatus at adjustable positions along said apparatus essentially in a direction lateral to the direction of force which results when said strap is placed in tension, said system comprising a buckle for said strap having a first end thereof secured to the end of said strap, a flexible track for engaging said strap end, said track having a relatively narrow width with respect to length and a relatively constant thickness along its length, said track being adapted to be secured along one longitudinal edge thereof to said backpack apparatus and having an enlarged thickness along the opposite longitudinal edge thereof formed for sliding capture in a clamp, and a clamp mechanism forming a second end of said buckle and engaging said track in captured sliding relation, said clamp mechanism of said buckle having a reduced entrance opening disposed at said second end thereof forming a slide hole which permits said enlarged thickness edge of said crack to be captured therein whereby said clamp may be slid and located anywhere along said track but said enlarged thickness prevents said track from being pulled laterally out of said clamp, said clamp mechanism including a cam member secured to one side of said reduced entrance opening in pivoting relationship therewith and having an arm extending therefrom whereby when said arm is rotated toward said first end of said buckle, said cam member extends from its respective side of said opening in said clamp body toward the other side thereof whereby the proximate portion of the relatively constant thickness portion of said track is clamped between said cam member and said other side of said opening thereby engaging said buckle to said track at said proximate portion thereof.

2. A method for providing an infinitely adjustable position harness buckle system for backpack apparatus having at least one strap end which is secured to said apparatus at adjustable positions along said apparatus essentially in a direction lateral to the direction of force which results when said strap is placed in tension, the steps comprising securing a buckle to said strap end, securing a track to said backpack apparatus along the path in which it is desired to move said buckle, said track being formed of a flexible material having a relatively narrow width with respect to length and a relatively constant thickness along its length, said track being adapted to be secured along one edge thereof to said apparatus, the other edge of said track having an enlarged thickness extending along the length of the longitudinal edge thereof formed for sliding capture in a clamp, said buckle including a clamp mechanism having a reduced entrance opening forming a slide hole which is disposed at one end thereof and formed to engage said track and which permits said enlarged thickness edge of said track to be captured therein whereby it cannot be pulled laterally out from said clamp, said clamp mechanism including a cam member secured to one side of said opening in pivoting relationship therewith and having an arm extending therefrom whereby when said arm is rotated around said pivot said cam member extends from the respective side of said opening in said clamp mechanism toward the other side thereof, inserting said track endwise into said clamp mechanism with the enlarged thickness edge of said track captured in said slid hole behind the reduced entrance opening of said clamp mechanism in sliding relation therewith, moving said buckle laterally with respect to said track to any desired position therealong, and rotating said arm of said cam member to extend said cam member toward the other side of said opening thereby clamping the proximate portion of the relatively constant thickness portion of said track therebetween and thereby said buckle to said track whereby said strap end attached to said buckles locked into a fixed orientation with respect to said track.

* * * * *